US006400330B1

(12) United States Patent
Maruyama et al.

(10) Patent No.: US 6,400,330 B1
(45) Date of Patent: Jun. 4, 2002

(54) BAR ANTENNA AND METHOD OF MANUFACTURING THE SAME

(75) Inventors: Kota Maruyama, Toyoake; Wataru Yagi, Nagoya; Eiji Mushiake, Aichi-ken; Wataru Kuwayama, Nagoya, all of (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/879,092

(22) Filed: Jun. 13, 2001

(30) Foreign Application Priority Data

Jun. 13, 2000 (JP) ..... 2000-177061

(51) Int. Cl.[7] ..... H01Q 7/08
(52) U.S. Cl. ..... 343/788; 343/867; 343/713
(58) Field of Search ..... 343/787, 788, 343/867, 742, 713

(56) References Cited

U.S. PATENT DOCUMENTS 3,778,836 A * 12/1973 Tanaka ..... 343/702
3,965,474 A * 6/1976 Guerrino et al. ..... 343/719
4,760,394 A * 7/1988 Takeuchi et al. ..... 340/825.54
6,163,305 A * 12/2000 Murakami et al. ..... 343/788

FOREIGN PATENT DOCUMENTS

JP 9-307327 A 11/1997 ..... H01Q/1/24

* cited by examiner

*Primary Examiner*—Don Wong
*Assistant Examiner*—Hoang Nguyen
(74) *Attorney, Agent, or Firm*—Burns, Doane, Swecker & Mathis, LLP

(57) ABSTRACT

A bar antenna includes a single body ferromagnetic substance core, a bobbin which accommodates the core in a hollow space and has a plurality of coil windings, a case in which is positioned the core and the bobbin, and a potting material in the case and/or the bobbin. The potting material isolates the core from temperature changes, humidity changes and vibration.

20 Claims, 4 Drawing Sheets

BAR ANTENNA AND METHOD OF MANUFACTURING THE SAME

This application is based on and claims priority under 35 U.S.C. § 119 with respect to Japanese Application No. 2000-177061 filed on Jun. 13, 2000, the entire content of which is incorporated herein by reference.

FIELD OF THE INVENTION

The present invention generally relates to a bar antenna used to receive radio waves. More particularly, the present invention pertains to a bar antenna positionable at a variety of different places on a vehicle, including the vehicle door handle or the vehicle door mirror, or on portions of a house such as the door, for receiving radio waves, and a method of manufacturing a bar antenna.

BACKGROUND OF THE INVENTION

Somewhat recent developments have led to electric key-less entry systems for homes and electric key-less entry systems for vehicles. According to these electric entry systems, as soon as the person carrying the electric key for the entry system touches, for example, the door knob, the system unlocks the entry system. With this type of entry system, an antenna must be placed within two or three meters of the entry system.

Generally speaking, a bar type antenna is utilized and is made from ferrite material having high magnetic permeability. One example of such material is high magnetism ceramic material. This known type of bar antenna formed from ceramic material is susceptible of certain disadvantages and drawbacks in that the antenna tends to be relatively fragile.

The material quality of the core placed in the antenna will deteriorate over time. If a small amount of shock or vibration is applied to the core for a relatively extended time, it is difficult to prevent the formation of a crack on the core. The crack shortens the actual length of the antenna and deteriorates the response of the entry system.

One suggestion proposed in Japanese Patent Laid-Open Publication No. 9-307327 involves constructing the ferrite bar-type antenna to possess sufficient strength. The published application describes connecting a plurality of ferrite cores in an aligned manner and placing the ferrite cores into a tube while winding a coil on the outer surface of the tube. According to this structure, a core having the appropriate length is put into the tube to prevent the formation of a crack.

However, with this bar antenna, gaps exist between the cores, thus reducing the sensitivity of the antenna as compared to an antenna having a core defined by single structure. Moreover, the gaps cause the connection between each of the cores to be relatively unstable. This also reduces the responsiveness and reliability of the antenna performance.

In light of the foregoing, a need exists for a bar antenna having a stable receiving capacity and stable performance, while at the same time not being as susceptible to the possibility of damage to the same extent as the other known antenna's described above.

SUMMARY OF THE INVENTION

According to one aspect of the invention, a bar antenna includes a single body ferromagnetic substance core, a bobbin accommodating the core and having at least one coil outside of the bobbin, a case in which is positioned the core and the bobbin, and a potting material between the core and the bobbin.

According to another aspect of the invention, a method for manufacturing a bar antenna involves winding a plurality of coils onto a bobbin, placing a single body ferromagnetic substance core into a hollow space of the bobbin, positioning the bobbin in a case, and introducing a potting material into the hollow space of the bobbin.

Another aspect of the invention involves a bar antenna in combination with a portion of a vehicle. A case is mounted on a mounting surface of the portion of the vehicle, a bobbin is positioned in the case and has a hollow space, a one-piece ferromagnetic core is positioned in the bobbin, at least one coil winding is wound around the outside of the bobbin, and a potting material is located between the bobbin and the case, and between the core and the bobbin.

In accordance with the present invention, the core is insulated from temperature change, humidity change and shock or vibration by virtue of the potting material. The potting material positions the core generally at the center of the bobbin and affixes or secures the core and the bobbin together.

BRIEF DESCRIPTION OF THE DRAWINGS FIGURES

The foregoing and additional features and characteristics of the present invention will become more apparent from the following detailed description considered with reference to the accompanying drawing figures in which like reference numerals designate like elements and wherein:

FIG. 1*a* is a cross-sectional view of the bar antenna according to the present invention;

FIG. 1*b* is an enlarged cross-sectional view of the circled portion of the bar antenna shown in FIG. 1*a* illustrating the construction of the bar antenna at one end portion of the bar antenna;

FIG. 1*c* is an enlarged cross-sectional view of the opposite end portion of the bar antenna shown in FIG. 1*a;*

DETAILED DESCRIPTION OF THE INVENTION

Figure 3:
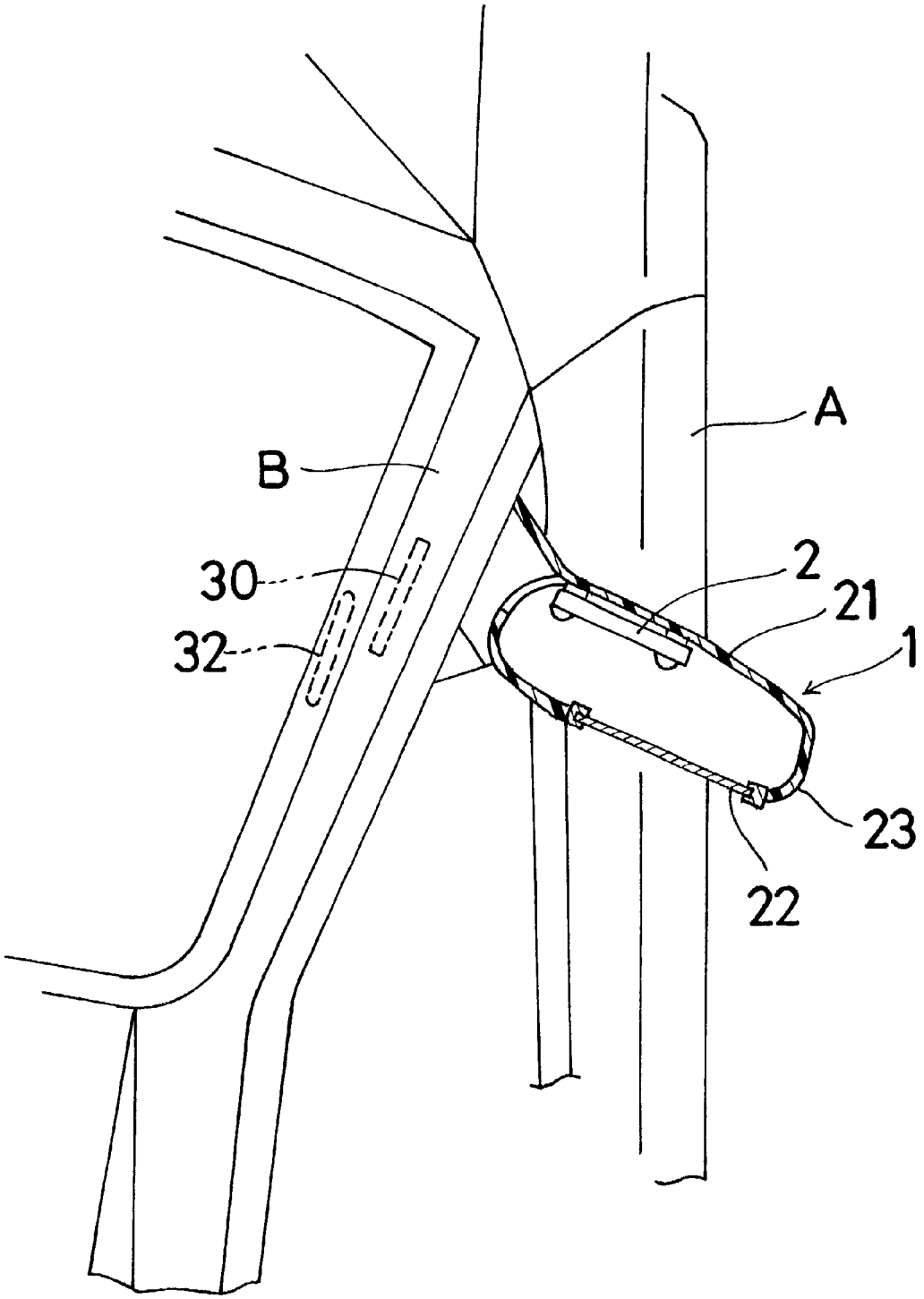
FIG. 3 is a top perspective view of the front right side portion of a vehicle illustrating, in cross-section, the vehicle door mirror provided with a bar antenna in accordance with the present invention.

The bar antenna of the present invention is useful in a variety of different applications. FIG. 3 illustrates one useful application involving an outside vehicle door mirror (i.e., vehicle side mirror). As shown in FIG. 3, the vehicle door mirror 1 is mounted on the vehicle door A. FIG. 3 also illustrates the right side pillar B (vehicle body portion) of the front window.

The door mirror 1 has a back cover 21 mounted on the door and a front portion 23. A mirror 22 is mounted on the front portion 23 and a bar antenna 2 is mounted inside the mirror on the inner portion or inner surface of the back cover 21. The bar antenna is secured in place in the mirror, for example by securing the opposite ends of the bar antenna 2 to the inner portion of the mirror.

Figure 1A:
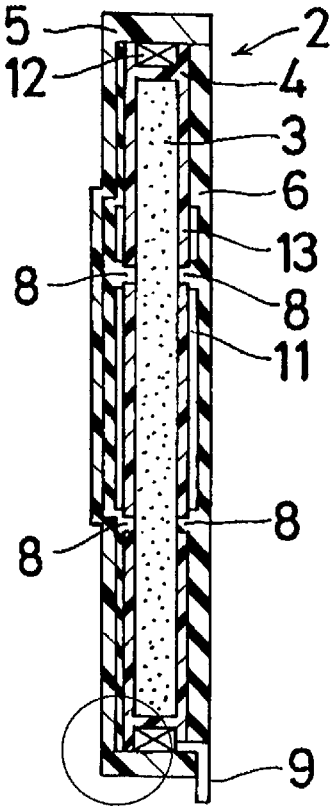
Figure 1B:
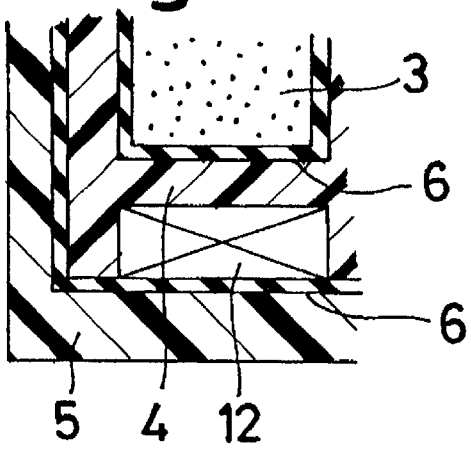
Figure 1C:
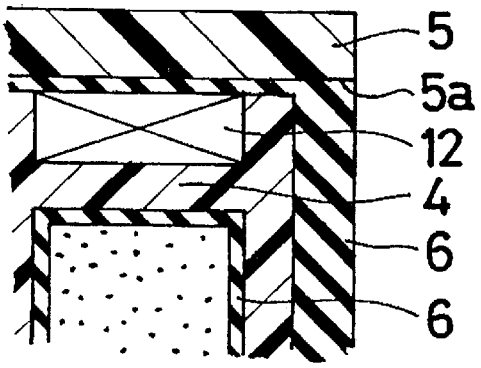

Various details associated with the bar antenna are shown in FIGS. 1*a*–1*c*. The bar antenna 2 includes a core 3, a bobbin 4, a case 5 and a potting or filler material 6. The core 3 is bar-shaped, having an elongated form and a relatively thin or small thickness. The core 3 is positioned in the bobbin 4, and both the core 3 and the bobbin 4 are positioned in the case 5. The case 5 is generally U-shaped in cross-section with an opening 5*a* along one side for allowing the bobbin 4 (and the enclosed core 3). The potting or filler material 6 is injected into the case 5 to hold the bobbin 4 (and the core 3) in place within the case 5.

In the illustrated and described embodiment, the core 3 is constructed as a one-piece body and is made from a ferromagnetic substance. Also, the bobbin 4 can be fabricated through use of a resin molding process.

Figure 4:
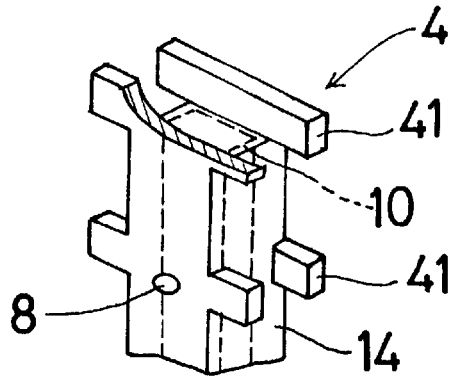
FIG. 4 is a perspective view of a portion of the bobbin forming the bar antenna.

As shown in FIG. 4, a hollow space 10 is formed in the bobbin 4 and a plurality of guide projections 41 are formed along the outer surface of the bobbin 4. The guide projections 41 extend outwardly away from opposite sides of the bobbin as illustrated and are spaced apart from one another at a predetermined interval along the longitudinal extent of the bobbin 4. The guide projections 41 are positioned to form two spaced apart rows of guide projections along each side of the bobbin 4, with each row extending along the length of the bobbin 4. Thus, as shown in FIG. 4, two spaced apart rows of guide projections 41 extend from the right side of the bobbin 4 while two rows of guide projections extend from the left side of the bobbin. As a result, a generally centrally positioned groove or recessed region 14 is provided along the outer periphery of the bobbin, extending along of the opposite sides of the bobbin 4 as well as along the opposite ends of the bobbin 4.

Figure 2:
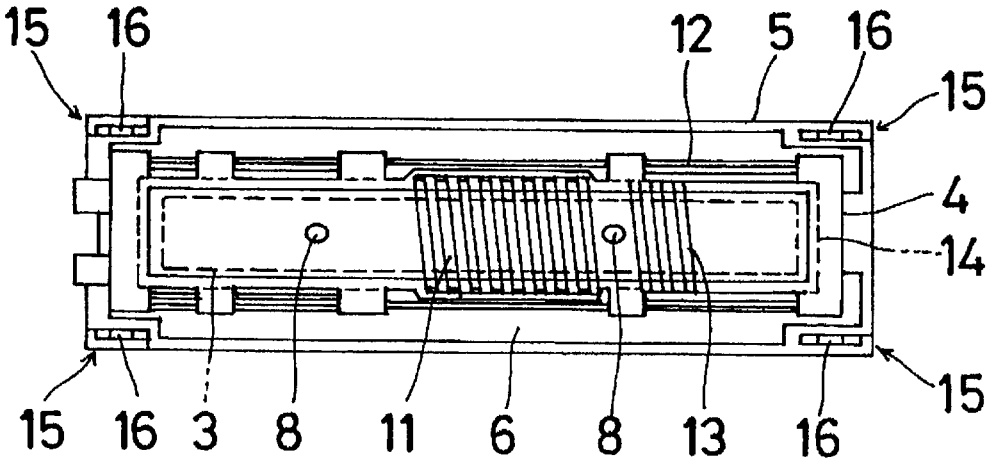
FIG. 2 is a plan view of the bar antenna shown in FIG. 1.

The bar antenna also includes three coils wound on the bobbin 4. The three coils include a main coil 11, a union coil 13 and a side coil 12. As shown in FIGS. 1*a*, 1*b* and 2, the main coil 11 is wound on the center portion of the bobbin 4 at a position located between several of the guide projections 41 as illustrated. The union coil 13 is wound about the bobbin to one side of the main coil 11 as also illustrated. The side coil 12 is wound on the bobbin from end-to-end so that the side coils is positioned in the groove or recessed portion 14. Thus, the orientation of the side coil winding 12 is transverse to the orientation of the main coil 11 and the union coil 13. That is, the main coil 11 and the union coil 13 are wound about axes generally parallel to the longitudinal axis of the bobbin, while the side coil winding 12 is wound about an axis generally perpendicular to the winding axes of the main coil and the union coil 13. The guide projections 41 forming the recessed region on the bobbin 4 serves as a guide or a receiving region for the side coil winding 12. In the depicted embodiment, the bar antenna 2 is mounted on the door mirror 1 so that the longitudinal axis or longitudinally extending central axis of the core 3 is positioned parallel to the mirror 22 as shown in FIG. 3.

The case 5 can be made of resin material. As shown in FIG. 1*a*, an intermediate portion of the bottom (i.e., the left side as seen in FIG. 1*a*) of the generally U-shaped case 5 is recessed to define an outdented portion. The bottom of the case 5 thus possesses a stepped configuration. A plurality of attachment portions 15 are provided at each corner of the case 5. Pins formed on the back cover 21 of the mirror connect to the case 5 through holes 16 at each of the attachment portions 15.

The core 3 and the bobbin 4 are dimensioned and configured such that a clearance or space exists between the core 3 and the bobbin 4 as shown in FIGS. 1*a*, 1*b* and 1*c*. Similarly, the case 5 and the bobbin 4 are dimensioned and configured so that a space or clearance exists between the case 5 and the bobbin 4. The potting material 6 is injected into these spaces or clearances.

The potting material 6 possesses moisture-proof and heat-insulating properties. When the potting material 6 is dried, the material still has flexibility. In this embodiment, urethane rubber is used as the potting material 6. However, as an alternative, a silicone rubber can also be used for the potting material 6. Air bubbles can be eliminated from the rubber material prior to injection of the potting material 6 using a vacuum degassing process. The vacuum degassing process can be applied at any time before injecting the potting material 6 into the bar antenna 2.

Table 1 below sets forth examples of dimensions of the overall bar antenna 2 according to one embodiment. The dimensions are measured in mm (millimeter).

TABLE 1

| Thickness | Length | Width |
|---|---|---|
| 6.5 | 111.0 | 10.0 |

Configuring the bar antenna to possess dimensions along the lines noted above, particularly the length dimension, allows the bar antenna 2 to be placed in a vehicle door mirror 1 such as shown in FIG. 3.

The process associated with manufacturing the bar antenna 2 is as follows. One type of material that can be employed to manufacture the core 3 is a Mn (Manganese)/Zn (Zinc) ferrite material. As an alternative, a Ni (Nickel)/Zn (Zinc) ferrite or amorphous magnetic material can be used to fabricate the core 3.

Table 2 below sets forth the dimensions of the core 3 according to one embodiment.

TABLE 2

| Thickness (mm) | Width (mm) | Cross Section ($mm^2$) | Length (mm) | Weight (g) |
|---|---|---|---|---|
| 2.3 | 5.2 | 12.0 | 60.5 | 3.45 |

The bobbin 4 can be made from a polyester liquid-crystal polymer. The bobbin 4 can be formed as a two pieces structure, with a plurality of holes 8 being formed on the bobbin 4 as shown in FIGS. 1*a* and 4. The holes 8 can have a diameter of about 3 mm.

The core 3 is positioned in the hollow space 10 in the two-piece bobbin 4. The bobbin 4 accommodating the core 3 is then placed in the case 5. The case 5 can also be made from the same material as the bobbin 4.

The potting material 6 is injected or introduced into the case 5 in which is accommodated the bobbin 4 and the core 3. The potting material 6 thus flows into or is introduced into the clearance or space between the case 5 and the bobbin 4. The potting material 6 also flows through the holes 8 in the bobbin 4 and thus flows into or is introduced into the clearance or space between the core 3 and the bobbin 4. The potting material can be made of a urethane material having relatively low viscosity. The viscosity is preferably less than 40 poise. If the clearances or spaces are relatively small, the viscosity is preferably less than 20 poise.

The potting material 6 can be introduced into the case 5 through the opening 5*a* in the case 5. The potting material 6 can also be injected into the case 5 with the case being held in a mold under vacuum conditions. During injection, the potting material 6 is able to enter and fill the clearances or spaces in a relatively smooth manner. To harden or solidify the potting material 6, the bar antenna 2 can be placed in an environment at a temperature of 80° Celsius. The hardness of the potting material 6 after the hardening process is preferably less than 50 (JIS A Hardness), and more preferably less than 30 (JIS A Hardness), as measured by a method defined by JIS (Japanese Industrial Standard) K-6301. Preferably, the potting material 6 has a specific gravity less than 1.0, a Young's modulus significantly less than the core 3 and a Poisson's ratio greater than the core 3.

As mentioned above, the core 3 is positioned in the hollow space 10 of the bobbin 4, with the bobbin 4 and the core 3 then being positioned in the case 5. The potting material 6 made from flexible material is then introduced into the case through the opening 5*a* to cause the potting material 6 to flow into the clearance or space between the core 3 and the bobbin 4 by way of the boles 8 in the bobbin 4. With the potting material 6 positioned between the outer surface of the core 3 and the inner surface of the hollow space in the bobbin 4, the core 3 is effectively isolated from temperature changes, humidity changes and vibration, while maintaining a sufficient and desirable actual antenna length for a relatively long period of time. It is thus possible with the present invention to produce a bar antenna constructed as a single body bar antenna having a relatively stable receiving capacity and relatively stable performance. It is to be understood that it is also possible to introduce the potting material into the hollow space 10 of the bobbin 4 after the core 3 has been positioned in the hollow space 10, but prior to positioning the bobbin and the core in the case 5.

When the bar antenna 2 is placed in the vehicle door side mirror 1, the load generated by the closing door operation and applied to the bar antenna 2 is about 40 G. On the other hand, when the bar antenna 2 is placed in the vehicle door handle, the load generated by the closing door operation and applied to the bar antenna 2 is significantly greater, on the order of 200 G.

As mentioned, when the vehicle door A shown in FIG. 3 is closed relatively strongly or forcefully, actual experiments show that an acceleration of about 200 G is applied adjacent the door handle. Using a two-dimensional FEM (Finite-Element Method) analysis, the stress applied to a completely filled bar antenna 2 can be analyzed. A completely filled bar antenna 2 refers to a bar antenna 2 according to the present invention in which the core 3 is centrally positioned in the bobbin 4 (i.e., at the center portion of the hollow space 10 of the bobbin 4), is completely surrounded by potting material 6 and does not directly contact the bobbin 4. An incompletely filled bar antenna refers to a bar antenna in which potting material is not completely filled into the clearance or space. That is, some unfilled portions of the clearance or space may exist between the core 3 and the bobbin 4, or some portions of the core 3 may directly contact the bobbin 4.

The tested core 3 was prepared or manufactured to have the characteristics identified in Table 2 and was placed at the vehicle door handle. Using the two-dimensional FEM analysis, when an acceleration of 200 G is applied to the completely filled bar antenna incorporating the tested core, the maximum stress applied to the tested core 3 is analyzed to be 0.72 kgf/mm$^2$. According to these results, if the completely filled bar antenna is to be mounted on the vehicle door handle, the core 3 should be constructed to withstand a stress of at least 0.72 kgf/mm$^2$ and preferably more than 0.72 kgf/mm$^2$. On the other hand, when an acceleration of 200 G is applied to the incompletely filled bar antenna mounted on the vehicle door handle, the maximum stress applied to the tested core 3 was found to be 2.28 kgf/mm$^2$ using the two-dimensional FEM. According to this analysis, if the incompletely filled bar antenna is to be applied or mounted on the vehicle door handle, the core 3 should be constructed to withstand a stress of at least 2.28 kgf/mm$^2$ and preferably more than 2.28 kgf/mm$^2$. According to this analysis, it has been determined that the core 3 should be constructed to capable of withstanding stress higher than three times the measured value for the incompletely filled antenna to prevent the core from breaking even under the harshest of conditions. Thus, the core 3 should be constructed to withstand a stress of at least 6.84 kgf/mm$^2$, and preferably higher than such value.

Thus, if the core 3 is prepared or constructed for use in a bar antenna that is to be mounted on the vehicle door handle, but the bar antenna is instead mounted on the vehicle door mirror 1, the core 3 will be sufficiently strong to withstand the stress developed during the door closing operation. In this embodiment, the core possesses a strength capable of withstanding stress equal to or greater than 6.84 kgf/mm$^2$ using the aforementioned Mn/Zn ferrite material.

Figure 5:
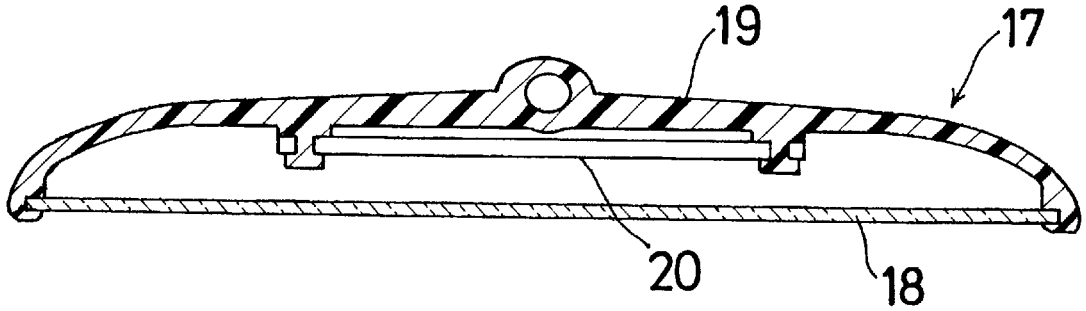
FIG. 5 is a cross-sectional view of a rear-view vehicle mirror, adapted to be positioned inside the vehicle, on which is provided the bar antenna of the present invention.

FIG. 5 shows an alternative embodiment in which the bar antenna 2 is mounted on the vehicle rearview mirror 17 that is located inside the vehicle. As illustrated, the mirror 18 is mounted on a housing 19. The bar antenna 20 which is placed or mounted on the housing 19 is located between the housing 19 and the mirror 18. The bar antenna 20 is positioned generally parallel with the mirror 18 at a position generally centered with respect to the housing 19.

Figure 6:
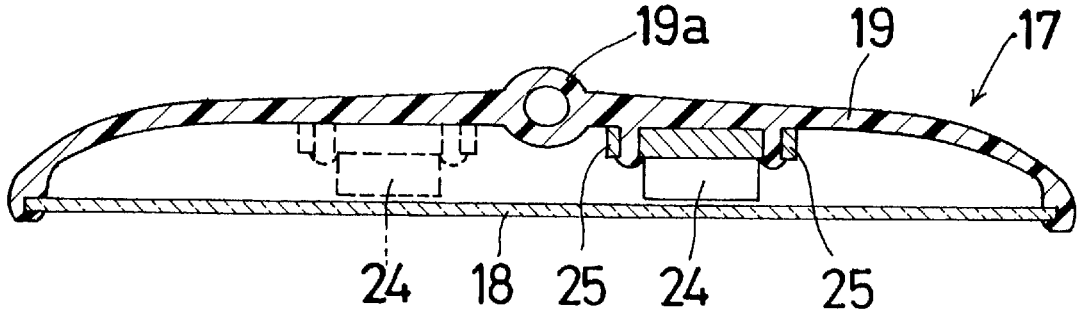
FIG. 6 is a cross-sectional view of another embodiment of a vehicle rear view mirror provided with a bar antenna in accordance with the present invention.
Figure 7:
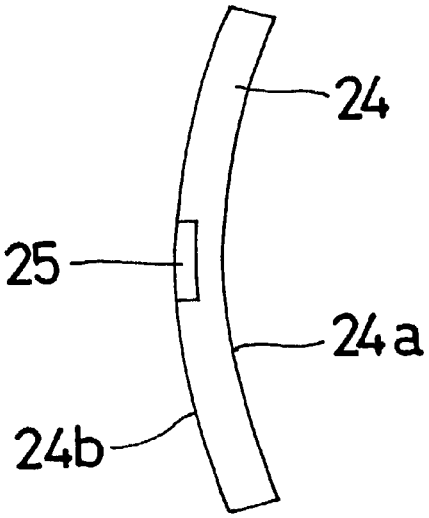
FIG. 7 is a side view of the bar antenna used in the rear view mirror shown in FIG. 6.
Figure 8:
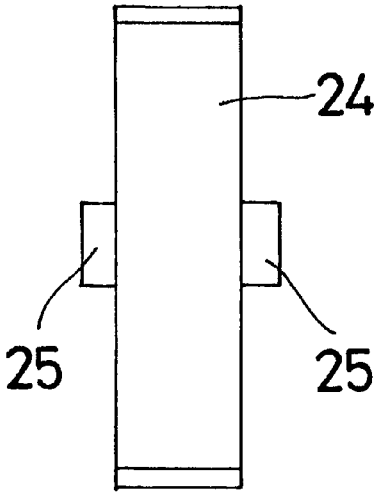
FIG. 8 is a front view of the bar antenna used in the rear view mirror shown in FIG. 6.

FIGS. 6–8 illustrate another embodiment of the present invention in which the bar antenna 24 is mounted on a vehicle rearview mirror 17. As shown, the bar antenna is positioned so that the longitudinal direction of the bar antenna 24 is located along the height of the mirror 18. In this embodiment, the bar antenna possesses a curved or arcuate shape. A pair of stays 25 are located at the bottom of the arcuate portion. The stays 25 are mounted on the housing 19, for example on mounting projections extending inwardly from the interior of the housing, to position the bar antenna in the mirror as shown in FIG. 6. The bar antenna is mounted within the mirror such that the curved surface 24*a* (i.e., the concave surface) of the bar antenna 24 faces the mirror 18. However, it is also possible to position the bar antenna such that the opposite curved surface 24*b* (i.e., the convex surface) faces the mirror 18. An alternative position for the bar antenna is shown by the dotted line position of the bar antenna 24' shown in FIG. 6. Further, two bar antennas 24, 24' positioned at the locations shown in FIG. 6 can be employed, wherein the two bar antennas are located at opposite sides of the central portion 19*a* of the mirror.

Figure 9:
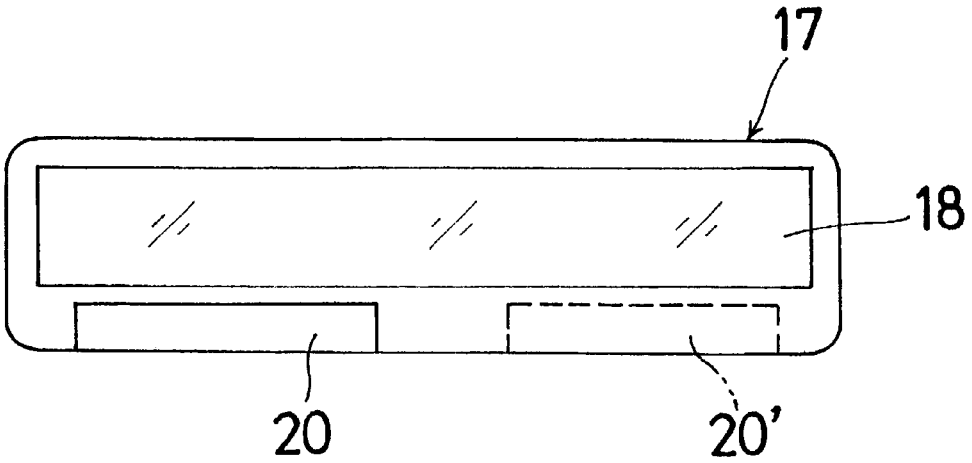
FIG. 9 is a plan view of a further embodiment of the rear view vehicle room mirror which has bar mirror.

FIG. 9 shows a further embodiment of the present invention. Here, the rearview mirror 17 has an expanded peripheral portion or frame portion at the bottom of the body or housing. The bar antenna 20 is placed on the inside of the expanded portion of the mirror 17. In this embodiment, the mirror 18 contains metal material and this metal material influences the reception of the bar antenna 20. In this regard, the bar antenna 20 is mounted at the lower front portion of the rearview mirror 17 to facilitate improved reception and thereby obtain a high degree of reception from all directions. The bar antenna can also be positioned at a different location, such as the dotted line position shown in FIG. 9. Also, to achieve an even greater degree of reception, two bar antennas 20, 20' can be placed on the rearview mirror 17 at the positions shown in FIG. 20 on either side of the central portion of the mirror. It is also to be understood that the bar antenna 24 shown in FIG. 6 and the bar antenna 20 shown in FIG. 9 can be positioned at a central location on the housing rather than to the side of the central portion as illustrated.

As shown in FIG. 1*a*, an electric wire or terminal 9 extends from the antenna 2 which receives a high frequency output signal. The high frequency output signal received by the antenna is output through the terminal 9. If a printed circuit that demodulates the signal from the antenna is located at the bar antenna, the signal from the printed circuit is output to a processing unit through the terminal or electric wire 9.

As mentioned above, the bar antenna has useful application in a variety of contexts, including portions of a vehicle such as the vehicle door handles, vehicle side view mirrors and the vehicle rearview mirrors. The bar antenna can also be placed in the vehicle pillar B as shown in FIG. 3 by the dotted line representation of the bar antenna 30. Additionally, the bar antenna can be placed in (e.g., molded in) the molding of the vehicle, such as shown by the dotted line representation of the bar antenna 32 which is located in the front window molding. The bar antenna can also be located in other locations of the vehicle such as in the side molding attached to the side of the vehicle or in the interior of the vehicle trunk. In these various embodiments, the bar antenna is positioned at a portion of the vehicle to fix the bar antenna in place relative to the portion of the vehicle.

It is also to be understood that the bar antenna can be used in other contexts as well. For example, the bar antenna can be applied to the handle of a door of a house. The bar antenna 2 can be made ring-shaped, for instance, and placed on the door knob of a door of a house. A ring-shaped bar antenna would also have high reception performance.

As mentioned above, the bar antenna according to the present invention is advantageously constructed as a single body bar antenna having an effective length for providing relatively stable reception and reception capacity, relatively stable performance and relatively highly reliability.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A bar antenna in combination with a portion of a vehicle, comprising:

a case mounted on the portion of the vehicle;

a bobbin positioned in the case;

a one-piece ferromagnetic core positioned in the bobbin;

at least one coil winding wound around an outside of the bobbin; and a potting material between an outside of the core and an inside of the bobbin, and between an inside of the case and an outside of the bobbin.

2. The bar antenna in combination with the portion of the vehicle as set forth in the claim 1, wherein a clearance is defined between the core and the bobbin, and the potting material is located in the clearance.

3. The bar antenna in combination with the portion of the vehicle as set forth in the claim 1, wherein a clearance is defined between the bobbin and the case, and the potting material is located in the clearance.

4. The bar antenna in combination with the portion of the vehicle as set forth in the claim 1, including at least one through hole formed in the bobbin and communicating with an interior of the bobbin in which is located the core.

5. The bar antenna in combination with the portion of the vehicle as set forth in the claim 1, wherein the portion of the vehicle is one of a vehicle rearview mirror, a vehicle side door mirror, a vehicle pillar and vehicle molding.

6. The bar antenna in combination with the portion of the vehicle as set forth in the claim 1, wherein the bobbin is made from polyester liquid-crystal polymer.

7. The bar antenna in combination with the portion of the vehicle as set forth in the claim 1, wherein the potting material is urethane rubber material.

8. A bar antenna comprising:

a single body ferromagnetic core;

a bobbin in which is accommodated the core, the bobbin having at least one coil wound outside the bobbin;

a case in which is positioned the core and the bobbin; and a potting material positioned in at least the bobbin.

9. The bar antenna as set forth in the claim 8, wherein a clearance is defined between the core and the bobbin, and the potting material is located in the clearance.

10. The bar antenna as set forth in the claim 8, wherein a clearance is defined between the bobbin and the case, and a potting material is located in the clearance.

11. The bar antenna as set forth in the claim 8, including at least one through hole formed in the bobbin and communicating with an interior of the bobbin in which is located the core.

12. The bar antenna as set forth in the claim 8, wherein the core is made from Mn/Zn ferrite material.

13. The bar antenna as set forth in the claim 8, wherein the bobbin is made from polyester liquid-crystal polymer.

14. The bar antenna as set forth in the claim 8, wherein the potting material is urethane rubber material.

15. A method of manufacturing a bar antenna comprising:

winding a plurality of coils onto a bobbin having a hollow space;

placing a single body ferromagnetic substance core into the hollow space of the bobbin;

positioning the bobbin in a case; and introducing a potting material into the hollow space of the bobbin.

16. The method as set forth in the claim 15, including eliminating air bubbles from the potting material prior to introducing the potting material into the hollow space of the bobbin.

17. The method as set forth in the claim 15, wherein the potting material has a viscosity less than 40 poise when introducing the potting material into the hollow space of the bobbin.

18. The method as set forth in the claim 15, wherein the potting material is introduced into hollow space of the bobbin after the bobbin is placed in the case.

19. The method as set forth in the claim 18, wherein the potting material is hardened by subjecting the potting material to an environment heated to at least 80° Celsius.

20. The method as set forth in the claim 15, wherein the potting material is introduced into the hollow space of the bobbin after the bobbin is positioned in the case by introducing the potting material into an opening in the case, with the potting material flowing through holes in the bobbin and being introduced into the hollow space of the bobbin.

* * * * *